United States Patent [19]

Tyler et al.

[11] Patent Number: 4,971,239

[45] Date of Patent: Nov. 20, 1990

[54] METHOD AND APPARATUS FOR MAKING WELDED TAPERED TUBES

[75] Inventors: Truett Tyler, Whittier; William A. Muller, Fillmore; Gregory A. Hart, Hayward; Michael G. Grabowski, Castro Valley, all of Calif.

[73] Assignee: Ameron, Inc., Monterey Park, Calif.

[21] Appl. No.: 287,727

[22] Filed: Dec. 21, 1988

[51] Int. Cl.[5] ..... B21C 37/04

[52] U.S. Cl. ..... 228/146; 219/613

[58] Field of Search ..... 228/146, 151, 152, 173.6; 219/61, 61.3, 62; 72/368

[56] References Cited

U.S. PATENT DOCUMENTS

| | | | |
|---|---|---|---|
| 3,452,424 | 7/1969 | Morris | 228/17.5 X |
| 3,691,337 | 9/1972 | Morris | 219/61.3 X |
| 3,802,329 | 4/1974 | Karmann et al. | 72/368 X |
| 4,148,426 | 4/1979 | Midzutani et al. | 228/146 |

FOREIGN PATENT DOCUMENTS

| | | | |
|---|---|---|---|
| 394 | 1/1973 | Japan | 228/151 |

*Primary Examiner*—Kenneth J. Ramsey

*Attorney, Agent, or Firm*—Christie, Parker & Hale

[57] ABSTRACT

A welded tapered tube is made by deforming a flat, elongated trapezoidal sheet of metal into an elongated, U-shaped trough in a wagon open at its top and having a U-shaped trough for a bottom. The wagon moves along a track to carry the U-shaped sheet past a series of fin rolls, which deform the U-shaped sheet into an oval-shaped, tapered tube with a seam running the length of the tube. The wagon and tube thereafter move past a welding station where the seam is forged and welded together to form an elongated, tapered tube with an oval-shaped cross section, which may be squeezed between two elongated and semicircular die cavities to form a tapered tube of circular cross section.

18 Claims, 8 Drawing Sheets

METHOD AND APPARATUS FOR MAKING WELDED TAPERED TUBES

BACKGROUND OF THE INVENTION

This invention relates to improved apparatus and methods for making tubing from sheet metal by shaping the metal sheet into the form of a tube with an oval-shaped cross section and a longitudinally extending seam, which is welded to form a closed tube. Thereafter, the oval-shaped tube may be deformed to have a circular cross section. By starting with a metal sheet in the shape of a trapezoid, tapered tubing may be formed. Sections of tapered tubing welding end-to-end make strong, lightweight, tapered poles useful as supports for traffic lights, street and highway lights, signs, power lines, and the like.

It has long been the practice to make sheet metal tubing of uniform or tapered diameter by starting with a strip of sheet metal and using forming rolls to shape the sheet into tubular form of oval cross section and with a longitudinal seam line which may be welded. For example, U.S. Pat. No. 3,452,424, issued July 1, 1969, to J. Morris for "Forming and Welding Tapered Tubes", discloses making tapered tubes from trapezoidal metal sheets. Two disadvantages of this prior art method and apparatus are:

(1) the edges to be welded together are deformed by edging rolls before the sheet is bent around the longitudinal axis of the sheet, which requires complex controls for the edging rolls to handle the trapezoidal shape of the metal sheet, and which can result in improper forming and positioning of the edges with respect to each other for welding; and (2) the work is supported on an adjustable roller as it passes a welding station, and is subject to imprecise positioning and support during the welding operation.

U.S. Pat. No. 3,253,452, issued May 31, 1966, to Scott for "Method and Apparatus for Forming Elongated Tubular Tapers" also discloses deforming a trapezoidal sheet of metal into a tapered tube with a noncircular cross section and a longitudinally extending seam line. Before welding the adjacent portions of the tube along the seam line, the Scott procedure requires deforming the tube into a circular cross section and then welding the seam. Although this method has produced satisfactory tubing, it is relatively slow and requires special handling to be sure that the unwelded seam of the round tube is in proper positioning for welding. Moreover, the prior art processes did not provide a good match in the outside diameters of adjacent ends of sections of tapered tubing welded together to form a pole. This was especially true when sheet metal of different gauges were used to try to save material.

This invention provides improved methods and apparatus for forming, efficiently and precisely, tubes of different shapes and sizes from pieces of sheet metal of different gauges, and which can be welded together to form attractive and structurally sound poles.

The apparatus can be quickly modified to produce cylindrical or tapered tubes of different cross sectional areas and shapes. Moreover, the longitudinal edges of the tube to be welded together are precisely formed and positioned with respect to each other to ensure precision and satisfactory welding of each tube produced in accordance with this invention.

In terms of method for forming a tube from a metal sheet having at least one pair of opposite side edges, the invention includes the steps of deforming the metal sheet around a central longitudinal axis to move the side edges toward each other until the sheet is in the shape of an elongated trough. Thereafter, the side edges are each deformed about a separate, respective side longitudinal axis until the sheet is converted from a trough to a tube having an oval cross section and an elongated seam where the opposing side edges are adjacent each other. The adjacent edges of the sheet are welded together to form a closed tube. If the final product is to have a circular cross section, the oval-shaped tube is thereafter disposed between a pair of spaced-apart, opposed, and substantially semicircular die cavities. The two die cavities are moved toward each other to cold-work and deform the oval-shaped tube into one of circular cross section.

In terms of apparatus, the invention includes an elongated track and an elongated wagon open at its top and mounted to roll on the track. The wagon has an upwardly facing bottom which is curved concave upwardly about a longitudinally extending axis to form a U-shaped trough in the bottom of the wagon. Means are provided for moving the wagon along the track. Means are also provided for supporting a metal sheet over the trough in the wagon at a U-ing station, and for deforming the metal sheet to fit in the trough and leave opposite side edges of the metal sheet projecting up from the wagon. At least one deforming roller over the track engages the side edges of the sheet projecting from the wagon (as the wagon moves along the track), and deforms the side edges toward each other to form a tube with an oval-shaped cross section and an elongated seam where the side edges are adjacent each other. Electrical welding means over the track engages the deformed side edges of the metal sheet as the wagon moves, and heats the edges to welding temperature. Forging rollers mounted over the track and adjacent the welding means drive the heated side edges of the strip together and form a closed tube with a welded seam extending for substantially the length of the tube.

Preferably, the welded tube is oval-shaped in cross section, and means, such as an O-ing machine, are provided for squeezing it into a substantially circular cross section.

For forming tapered tubes, the metal sheet is of trapezoidal shape, and the longitudinal axis of the bottom of the trough in the wagon is inclined with respect to the direction of the wagon travel on the track. In the preferred form, a removable die box with a sloping bottom fits inside the wagon to form the trough with the bottom inclined with respect to the direction of wagon travel. Spacers are preferably provided for fitting under the die box so that the height of the die box can be adjusted to accommodate metal sheets of different sizes.

The means for deforming the side edges of the sheet to close the tube and form the seam is preferably a fin roller.

DESCRIPTION OF THE PREFERRED EMBODIMENTS

Figure 1:
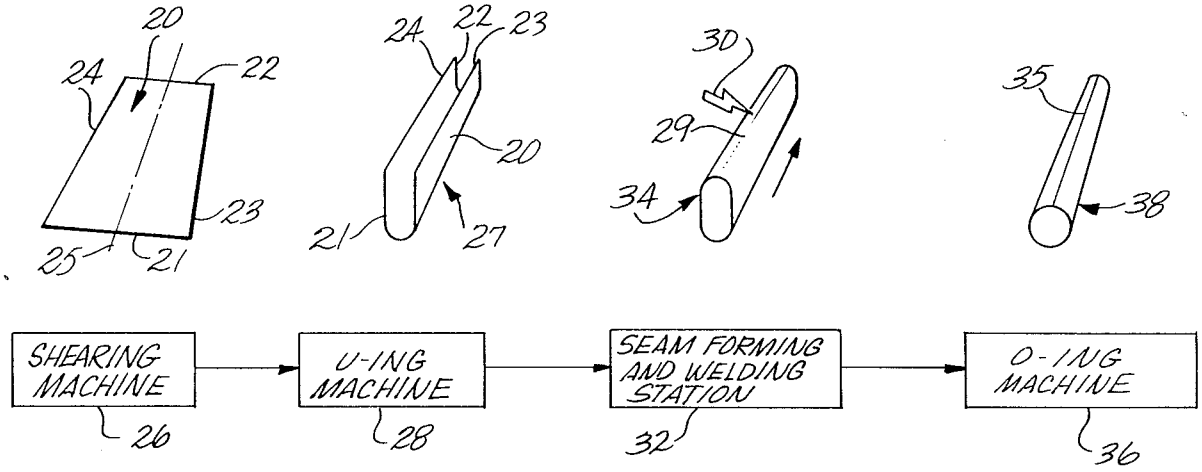
FIG. 1 is a diagram of the principal steps in forming a tapered tube from a metal sheet in the form of a trapezoid.

Referring to FIG. 1, an elongated metal sheet 20 in the shape of a trapezoid having parallel end edges 21 and 22 of unequal length and converging side edges 23 and 24 of equal length disposed about a central longitudinal axis 25 of the sheet is formed at a shearing machine 26, which may be of conventional type.

The trapezoidal sheet is formed into an elongated trough 27 of U-shaped cross section at a U-ing machine 28. The side edges 23 and 24 of the sheet are deformed toward each other to form an unwelded seam 29, which is closed by an electrical resistance welder 30 at a seam-forming and welding station 32 to form a welded tapered tube 34 having an oval-shaped cross section with a longitudinally extending welded seam 35. An O-ing machine 36 compresses the oval-shaped tube in the direction of the long axis of the oval to form a tapered tube 38 having a circular cross section.

Figure 2:
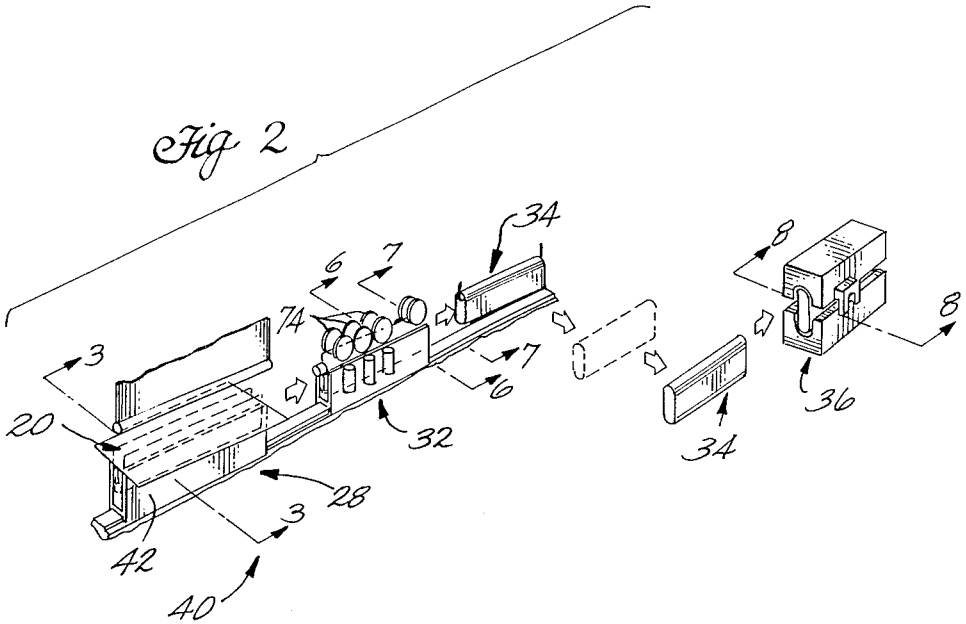
FIG. 2 is a perspective view of a production line for making tubes in accordance with this invention.

The operations just described with respect to FIG. 1 are performed on a production line 40, shown in FIG. 2, and which includes the U-ing machine 28, the seam-forming and welding station 32, and the O-ing machine 36.

Referring to FIGS. 2–5, the production line includes an elongated wagon 42 open at its top and mounted on four wheels 44 to ride back and forth on a horizontal and elongated track 46 (FIG. 6) when supplied power from a source (not shown) through an endless chain 48 (FIG. 5) connected at opposite ends of the wagon.

An elongated die box 50, having an upwardly opening and longitudinally extending U-shaped cavity 52, rests on two parallel, longitudinally extending rows 53 (FIGS. 3 and 4) of thirteen stacks 54 of spacers 55. Only three of the thirteen stacks are shown in FIG. 5 (which is not to scale). The stacks rest on a bottom wall 56 of the wagon. FIGS. 3–7 show each stack as including two spacers. The number of rows can be increased, as needed, to support larger die boxes used to make larger sizes of tubing. In addition, each stack height can be changed, or eliminated, to accommodate sheets of different sizes. For example, the spacers may be removed so that the die box rests on the bottom of the wagon. With this configuration, a larger sheet of metal may be processed to make a tube of larger diameter than that shown in FIGS. 6 and 7. Different die boxes, die cavities of different dimensions, can also be used with a variety of combinations of spacers to make tubes of almost any required size. The apparatus of this invention can be used to make 10-foot sections of tapered tubing which taper about $1\frac{3}{8}$ per 10 feet of length, with outside diameters from about 2-$\frac{3}{8}$" to about 24" or more at the small end, and sheet metal with a thickness from about 14-gauge up to $\frac{1}{2}$".

The bottom of the die box U-shaped cavity 52 slopes upwardly in the forward direction of wagon travel (from left to right as viewed in FIG. 5) by an amount which is equal to one-half the difference between the lengths of the end edges 21 and 22 of the trapezoidal metal sheet 20.

Figure 3:
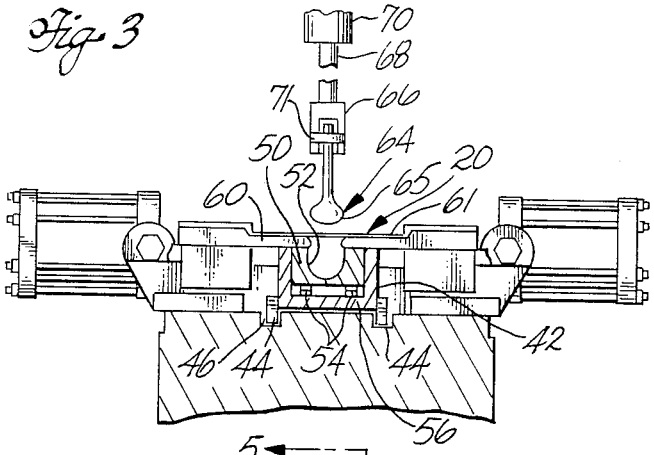
FIG. 3 is a view taken on line 3—3 of FIG. 2 showing a flat metal sheet in position in a U-ing machine to be deformed into a U-shaped trough by a punch.

As shown in FIG. 3, the flat metal sheet 20 is disposed over the U-shaped die cavity 52 of the die box 50 in the wagon, and rests on a pair of elongated and horizontal forming blades 60 and 61 on opposite sides of the die box so the longitudinal axis of the sheet is vertically above the longitudinal axis of the U-shaped die cavity 52. The blades extend for the length of the die box. An elongated, horizontal punch 64 having a downwardly facing convex bottom 65 shaped to fit in the die cavity 52 is disposed over the longitudinal centerline of the wagon, and is suspended by a pair of longitudinally spaced shackles 66, each of which is carried at the lower end of a respective vertical piston rod 68 mounted in a respective cylinder 70 so the punch can be extended down into and retracted up out of the die box cavity. Each shackle is secured to the punch by a respective horizontal, transverse shackle pin 71, which permits the punch to rotate about a horizontal transverse axis between the shackles so the lower portion of the punch can bottom fully in the sloping bottom of the U-shaped die cavity 52.

Figure 4:
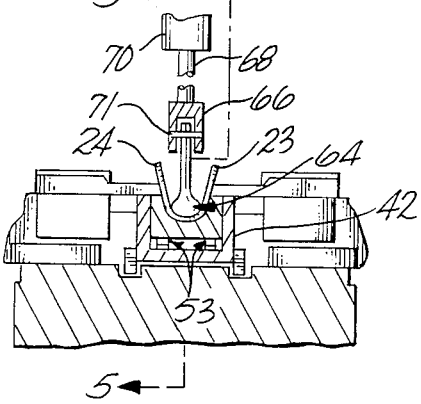
FIG. 4 is a view similar to that of FIG. 3, but showing the punch extended to deform the metal sheet into a U-shaped trough.
Figure 5:
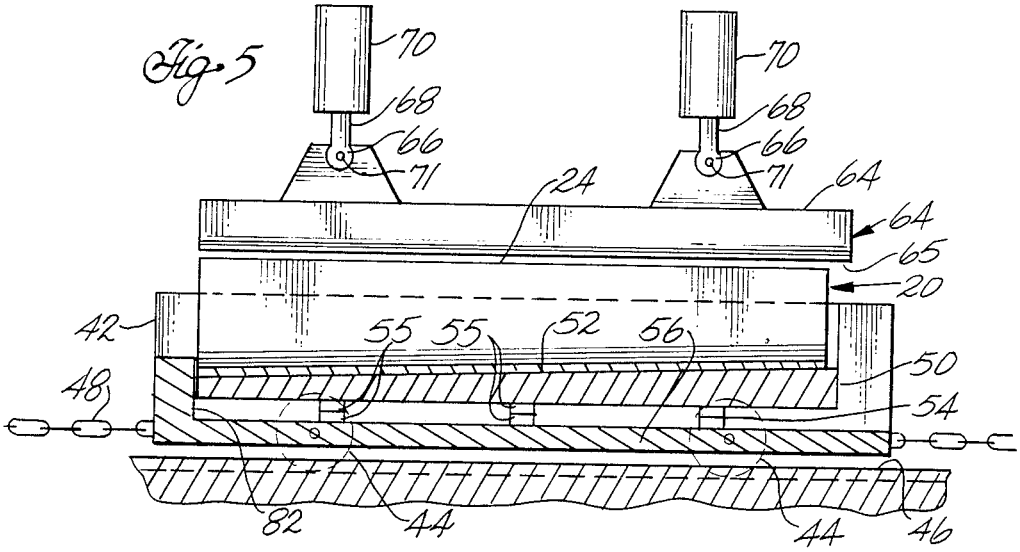
FIG. 5 is a view taken on line 5—5 of FIG. 4, except that the punch is withdrawn from the extended position to the retracted position shown in FIG. 3.

After the metal sheet 20 is placed over the die cavity 52 and rests on the forming blades 60 and 61, as shown in FIG. 3, hydraulic pressure applied to the cylinders 70 from a source (not shown and which may be of conventional type) forces the piston rods and the punch down from the retracted position shown in FIG. 3 to the extended position shown in FIG. 4 so that the flat sheet is deformed into the shape of an elongated trough, which is U-shaped in cross section. The forming blades may be moved in and out, as required, to give the sheet the desired U shape. The forming blades, and the action of the forming blades is similar to apparatus such as that shown in U.S. Pat. No. 3,253,452 to Scott.

As hydraulic fluid is supplied to cylinders 70, the piston rods 68 force the punch down into contact with the top surface of the sheet, which is forced into the die box cavity and into the U-shaped trough shown in FIGS. 1 and 4. The forward (right, as viewed in FIG. 5) end cylindrical bottom of the punch and the metal sheet bottom out against the higher end of the bottom of the trough in the die box cavity, and the rearward piston rod continues downwardly until the rear end of the cylindrical punch and metal sheet bottom out in the deeper end of the trough. This movement is facilitated by the transverse shackle pins 71, which secure the shackles and piston rods to the punch. The radius of curvature of the punch bottom and of the bottom of the U-shaped cavity 52 decrease from left to right (as viewed in FIG. 5) at a rate corresponding to the taper of the tube to be made from the sheet.

After the U-ing operation on the metal sheet at the U-ing machine 28 (FIGS. 1 and 2), the upper edges (side edges 23 and 24) of the sheet project above the top of the wagon by any suitable distance, as shown in FIG. 4. For example, for many sizes of tubes, each side of the sheet may project several inches above the upper edge of the wagon. Because of the sloping bottom of the die box cavity, the upper edges of the metal sheet are substantially horizontal.

If cylindrical tubes are to be made, the metal sheet is rectangular (rather than trapezoidal), and the die box cavity bottom is of uniform radius throughout its length, and is horizontal, instead of sloping, as shown in FIG. 5, which is not to scale, and shows an exaggerated slope for clarity.

Figure 6:
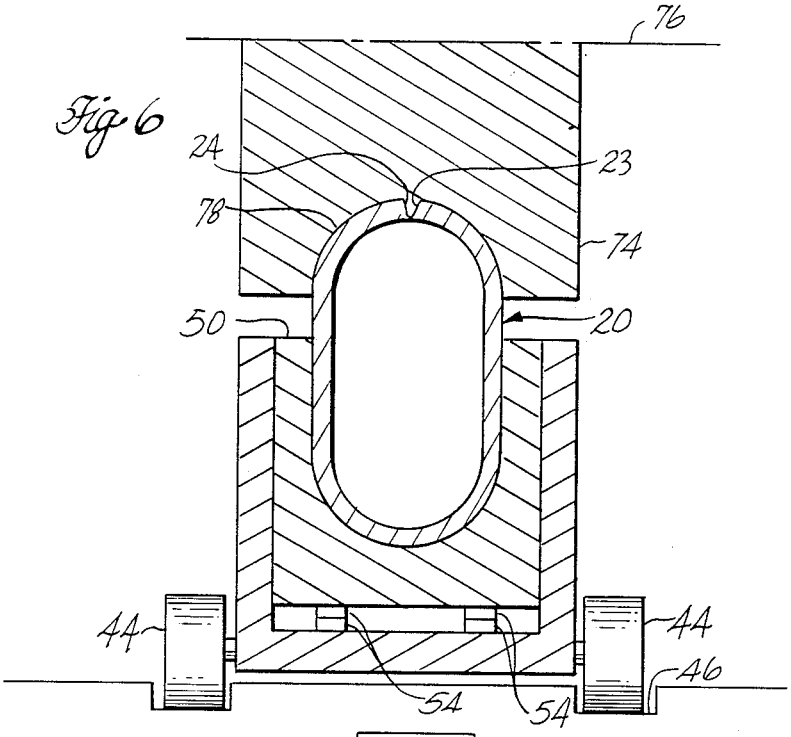
FIG. 6 is a view taken on line 6—6 of FIG. 2.
Figure 7:
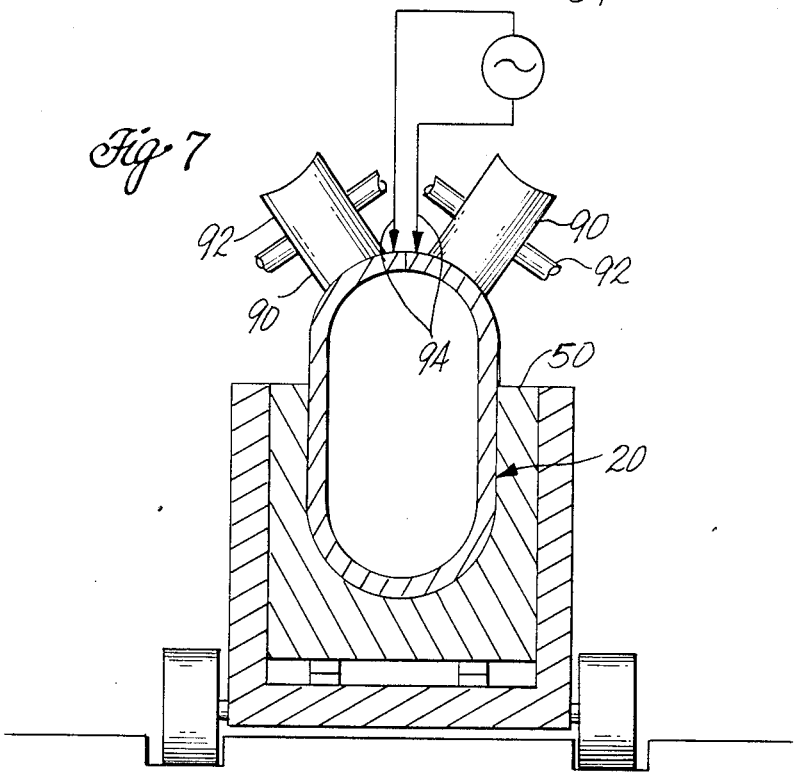
FIG. 7 is a view taken on line 7—7 of FIG. 2.

After the metal sheet is formed into the U-shape shown in FIG. 4, the wagon is advanced (from left to right, as shown in FIGS. 2 and 5) to carry the forward ends of the upper edges of the sheet through a series of three edge-forming fin rolls 74 mounted in tandem, as shown in FIG. 2, over the track on which the wagon travels. The fin rolls are mounted on frames (not shown in detail), which may be conventional, and are adjustable by means (not shown), which also may be conventional, to be set to deform the upper edges of the metal sheet progressively inwardly until the side edges 23 and 24 take the shape of the final edge-forming fin roller, as shown in FIG. 6. Each fin roll is mounted to rotate about a respective axis 76 (FIG. 6), and includes an outwardly opening, annular, concave groove 78 with an outwardly and radially extending annular fin 80 formed in the center of the groove. The final compression applied by the third fin roll deforms the sheet metal and forces it to take the position shown in FIG. 6 so that the adjacent side edges are precisely formed and located for precision welding, as described below. The sheet is now in the shape of a tube with an oval cross section and with an elongated seam running for the length of the tube where the sheet side edges engage the fin of the fin roll.

As shown in FIG. 5, the rear ends of the die box 50 and metal sheet bear against the forward face of an upright stop block 82 rigidly mounted in and secured to the bottom of the wagon to prevent the metal sheet from moving rearwardly with respect to the wagon as the upper edges of the metal sheet engage the fin rollers.

As the wagon continues to advance, the upper portion of the now-oval-shaped tube is forced under a pair of inclined welding rollers 90 (FIG. 7) mounted on opposite sides of the seam to rotate about respective inclined shafts 92. A pair of electrical resistance welding electrodes 94 are disposed so that the electrodes contact the metal tube on opposite sides of the seam, and just before the tube is engaged by the welding rollers, which may be of conventional construction. The welding may be achieved by any suitable welding equipment, including conventional systems, such as the high-frequency welding disclosed in U.S. Pat. No. 2,818,488 to Rudd et al or U.S. Pat. No. 2,857,503 to Rudd et al. Alternatively, the high-frequency current required for welding may be maintained inductively in advance of the weld point by induction coils of conventional construction. In any event, the welding equipment heats the side edges of the tube adjacent the seam to welding temperature, and the welding rollers forge the seam together to form a strong welded joint.

Using welding rollers which apply pressure of about 10,000 p.s.i. to the welded joint forges the edges of the work together after heating and displaces metal impurities to the surface, leaving a clean and strong weld substantially throughout the thickness of the tubing wall.

After the welding operation, the oval-shaped tube is transferred to the O-ing machine 36 (FIG. 2). As shown in more detail in FIGS. 8–10, the O-ing machine includes an upper mold piece or die 100 having a downwardly opening, elongated, upper concave die cavity 102, which is substantially semicircular in cross section. A lower mold piece or die 104 includes an upwardly opening, elongated, lower concave die cavity 106, which is substantially semicircular in cross section and has a radius equal to that of the cavity in the upper mold piece. When used to make tapered tubes of circular cross section, the radius of each die cavity 102 and 106 progressively decreases in the direction of reduced diameter of the tapered tube. Thus, when the O-ing machine is closed, as shown in FIG. 9, the two die cavities form a tapered enclosure substantially corresponding to the shape of the exterior of the tapered tube.

A downwardly extending cylindrical dowel pin 108 in the upper mold piece has a tapered lower end to facilitate entry into an upwardly opening cylindrical dowel socket 110, which is tapered in its bottom to match the taper on the lower end of the dowel pin. The dowel pin and dowel socket assure accurate alignment of the two mold pieces as they move toward and away from each other.

Figure 8:
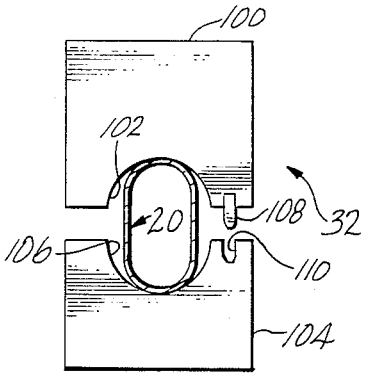
FIG. 8 is a view taken on line 8—8 of FIG. 2 at the O-ing machine.

As shown in FIG. 8, the oval-shaped tube is placed in the lower die cavity 106 of the O-ing machine, with the long axis of the oval vertical, i.e., parallel to the direction of relative travel between the two mold pieces. Thus, when the mold pieces are closed, as shown in FIG. 9, the oval-shaped tube is deformed under cold-working conditions and forced into the circular cross section formed by the two opposing cavities of the two mold pieces. After the tube is forced to the shape dictated by the die cavities of the O-ing machine, the machine is opened as shown in FIG. 10, and the welded and rounded tube is ready for removal. If the tube is cylindrical, the die cavities match that shape. If the tube is tapered, the die cavities are tapered to provide the required taper to the finished product.

Figure 9:
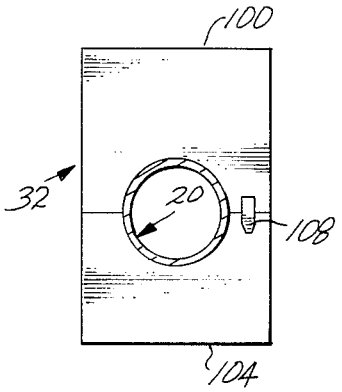
FIG. 9 is a view similar to that of FIG. 8, except the O-ing machine is closed to deform the oval-shaped tube into a tapered tube with a circular cross section.
Figure 10:
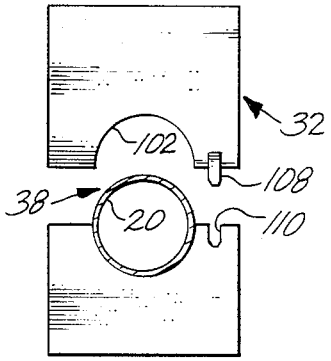
FIG. 10 is a view similar to FIGS. 8 and 9, but showing the O-ing machine open after the tube has been deformed into a circular cross section.

If desired, the die cavities of the O-ing machine can be shaped so that, when the mold is closed, as shown in FIG. 9, the enclosed cavity is slightly oval-shaped (not shown in FIG. 9) with the long axis of the slight oval extending perpendicular to the long axis of the tube oval shown in FIG. 8. In this way, the tube is deformed in a direction slightly past its final shape so that, when the mold is opened, the tube springs back to the desired final shape, which may be circular.

The structure and operation of the O-ing machine is substantially the same as that shown in U.S. Pat. No. 3,253,452 to Scott, with the important exception that the O-ing in the present invention is done after welding the longitudinal seam of the tube, instead of before, as in the Scott patent. Because of this difference, the "longitudinally extending internally projecting protuberance" (col. 4, lines 25–26) and reference number 73 in FIGS. 12–18 of the Scott patent) was removed from the prior art machine to adapt it for use in accordance with this invention.

When the tubes made in accordance with the methods and apparatus of this invention are tapered and of circular cross section, and are to be welded together end-to-end to form tapered light standards, sign posts, and poles for supporting utility lines, and the like, the typical finished product will taper about 1⅜" per 10 feet of tubing length.

Figure 11:
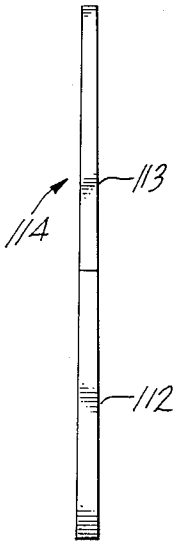
FIG. 11 is a side view of two sections of tapered tubing welded together to make a tapered pole.

FIG. 11 shows lower and upper tapered tubing sections 112 and 113, respectively, welded together end-to-end to form a tapered pole 114. By way of example, the lower section of tubing may have an outside diameter of 5¼" at its lower end and an o.d. of 3⅞" at its upper end, and the upper section of tubing will have an o.d. of 3⅞" at its lower end and an o.d. of 2⅜" at its upper end.

It is important for the adjacent ends of the tubing sections in the pole to have substantially the same outside diameter to facilitate providing a structurally and aesthetically acceptable weld at each joint. We have found that in making tapered tubes in accordance with this invention, it is advantageous to form the metal sheet into the U-shape shown in FIGS. 1 and 2 with the margin of the upper edges of the U-shaped sheet projecting from the wagon and die box to be substantially uniform throughout the length of the sheet. To this end, the bottom of the die box cavity slopes so that the upper edges of the trapezoidal sheet shown in FIG. 5 are substantially horizontal. This provides the precise forming and mating of the opposite edges by the last edge-forming fin roll, as shown in FIG. 6.

We have also found that better results are obtained by cutting the sheet metal to the proper trapezoidal shape so that the adjacent ends of tapered tubing sections in a pole have the same outside diameter. Unless this precaution is taken, the small end of a tapered section may be too large, and the large end of the adjacent tapered section may be too small, each by as much as ⅛". This difference in size required extra welding of the adjacent ends together, and resulted in unsightly joints. To avoid this problem in making tubing which tapers 1⅜" in 10 feet of length we cut each trapezoidal sheet so that the length of the longer end of each sheet was determined in accordance with the following formula:

$$L=(OD-MT).\pi+MT+.125",$$

where L is the length (in inches) of the longer of the two end edges of the trapezoidal sheet, OD is the final outside diameter (in inches) of the larger end of the pipe section, MT is the actual thickness of the metal sheet (in inches), $\pi=3.14$, and 0.125 is a constant (in inches). The shorter end of the trapezoidal sheet should be 47/16" less so the final product will taper 1⅜" in diameter for a 10-foot section of tubing. The above formula accommodates the squeezing which takes place at the welding of the longitudinally extending tubular seam, and permitted us to produce sections of tapered tubing which could be welded together end-to-end with almost a perfect fit. This avoided the need for fillet welding required around joints when the formula was not used, and resulted in finished tapered poles which appeared substantially monolithic, even if sheet metal of different gauges are used to make different sections of tapered tubing used in the same pole. This saves material by permitting use of sections of tapered tubing made with different gauge sheet metal. For example, certain 30-foot lighting poles, which must be designed to withstand winds up to 120 miles per hour, are made of three 10-foot sections of tapered tubing formed from sheet metal of different thicknesses. The lower 10-foot section is made of 3-gauge (0.2311" thick) sheet metal, the middle 10-foot section of tapered tubing is made of 7-gauge (0.1713") sheet metal, and the upper 10-foot section of tapered tubing is made of 10-gauge (0.1116" thick) sheet metal. Thus, by using sheet metal of a gauge which decreases with height, substantial savings are achieved in the amount of metal used.

In certain traffic signal poles, which may be 30 feet high, the center section of tapered tubing is subjected to the maximum stress. Accordingly, the lower section of tubing is made of 7-gauge sheet metal, the middle section of 3-gauge sheet metal, and the upper section of 10-gauge sheet metal.

The use of this invention permits the tubing sections made of different gauge sheet metal to be formed with end diameters of precise dimensions so the sections can be welded together with minimum time and material and maximum strength and aesthetic properties.

We have found that the size of the die box can be critical in producing satisfactory tapered tubing in accordance with this invention. For example, to make sections of tapered tubing which has an outside diameter of 2⅜" at its smaller end and 3⅞" at its larger end, we have found it satisfactory to use a die box which is about 2¼" wide. To make sections of tapered tubing which have an o.d. of 3⅞" at its smaller end and 5¼" at its larger end, or 5¼" at its smaller end and 6⅝" at its larger end, the width of the die box should be greater than 2¼". For example, we have found that a die box 3¼" wide produces a satisfactory product having the two sizes just mentioned. Moreover, using a die box that size for tubing sections of the given sizes, we have successfully formed and welded tubing sections of 3-, 7-, and 10-gauge sheet metal steel. Using a die box significantly less than 3¼" wide to make the two sections with end outside diameters between 3⅞" and 6⅝" causes a relatively short radius of curvature at each end of the oval, resulting in excessive cold-working and hardening during the forming operations. Thereafter, when samples of welded workpieces were subjected to the O-ing machine (and after having been formed in a die box only 2¼" wide), the product was deformed to such an extent that the welded seam often failed. This problem was rectified by forming products of the two sizes mentioned in the die box having a width of 3¼".

FIGS. 12–16 show the presently preferred embodiment for guiding the lower die 104 upwardly into proper position with respect to upper die 100 as the two dies are closed to deform the oval-shaped tubing section into one with a circular cross section. In the embodiment shown in FIGS. 12–16, the dowel pin 108 and dowel socket 110 (shown in FIGS. 8–10) are replaced by a pair of guide blocks 120 secured by bolts 122 to opposite sides of the upper die so that each guide block extends a substantial distance below the lower edge of the upper die. A separate lower roller 124 is mounted in each guide block to rotate about a respective horizontal and longitudinally extending shaft 126. The location and diameter of each lower roller is such that the horizontal distance between the innermost portion of each roller is slightly greater than the width of the lower die 104.

Figure 12:
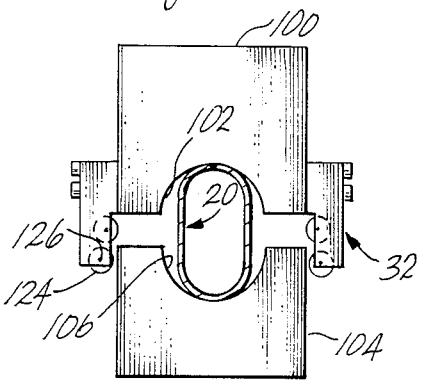
FIG. 12 is an end view of the presently preferred embodiment of the guide means for the dies in the O-ing machine, with the dies open.
Figure 13:
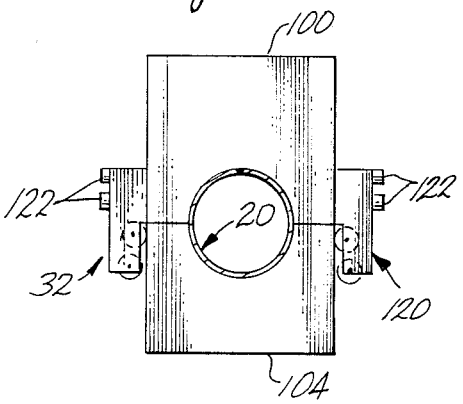
FIG. 13 is a view similar to that of FIG. 12, but with the dies closed.
Figure 14:
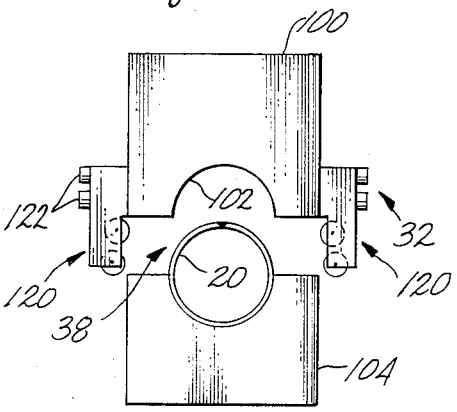
FIG. 14 is a view similar to that of FIG. 12, but with the dies open.
Figure 15:
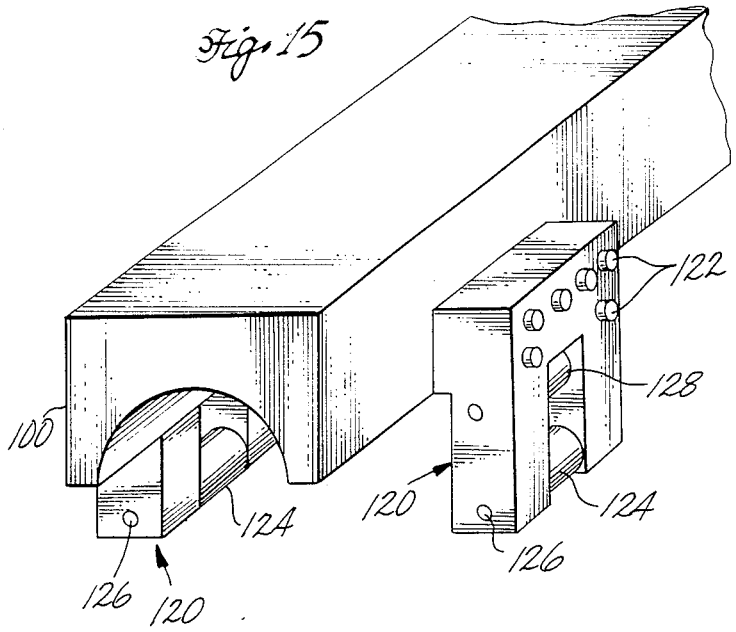
FIG. 15 is a fragmentary perspective view of one end of the preferred guide means for the upper die of the 0-ing machine.
Figure 16:
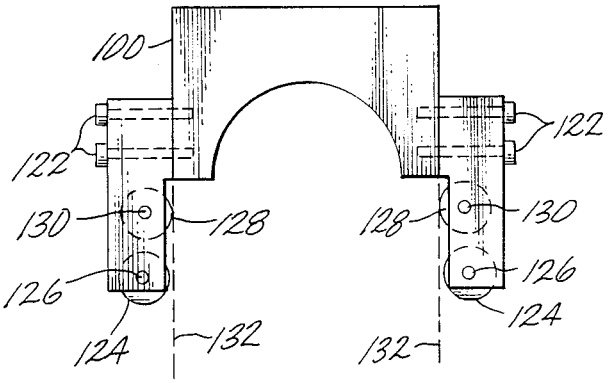
FIG. 16 is an end view of the preferred guide means for the upper die of the O-ing machine.

A separate upper roller 128 is mounted in each guide block to rotate about a respective horizontal and longitudinally extending shaft 130 mounted in each guide block. The location and diameter of each upper roller is such that the horizontal distance between the innermost portion of each roller makes a close rolling fit on the respective outside face of the lower die 104 as the lower die is forced upwardly against the upper die. The operation of the guide rollers is shown in FIGS. 12–14. In FIG. 16, the dotted lines 132, which represent the outer face of the lower die, show how the upper guide rollers ensure a precise fit of the two dies as they close.

Figure 17:
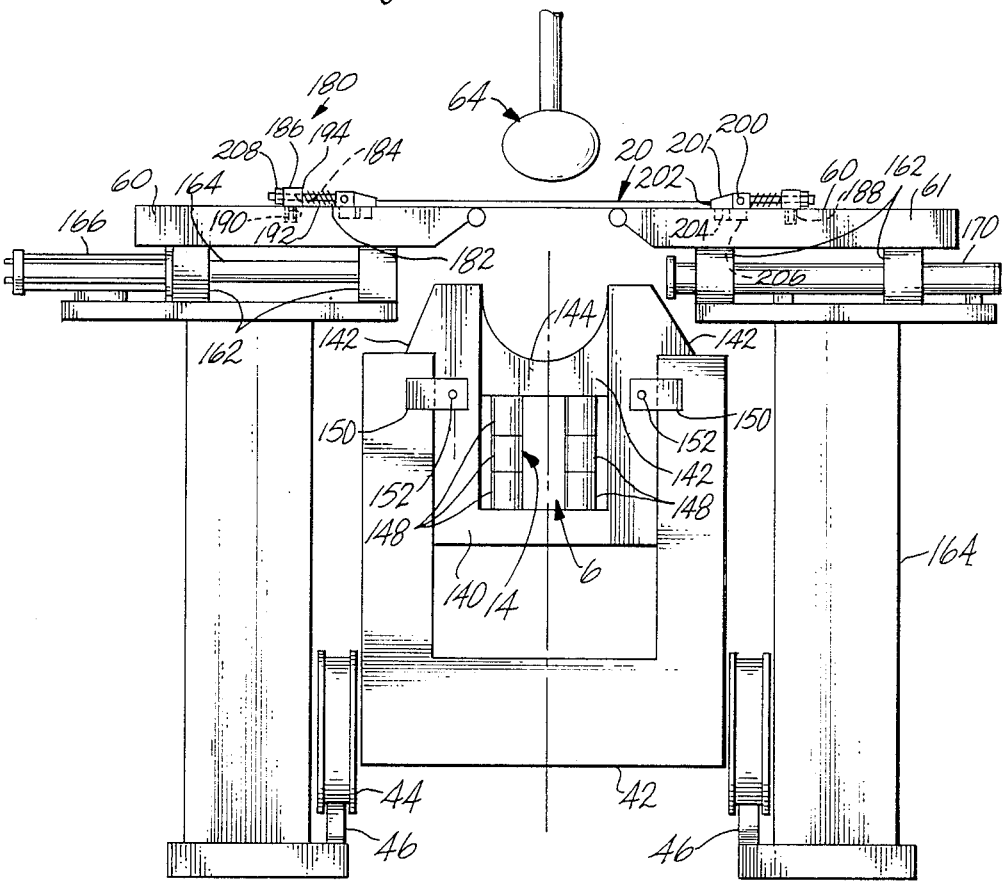
FIG. 17 is an end view of the presently preferred embodiment of the apparatus of this invention at the U-ing machine.

FIG. 17 is an end view of a presently preferred embodiment of a replaceable die box 140 mounted in the wagon 42, which carries the wheels 44 that ride on track 46.

The replaceable die box 140 includes a pair of outwardly extending ears 142, which rest on the upper edge of the wagon and extend longitudinally for the length of the wagon. A replaceable die box liner 142 having an upwardly facing concave surface 144 rests on stacks 146 of spacers 148 in the bottom of the replaceable die box.

The upwardly concave surface 144 of the replaceable die box liner extends longitudinally for the required length, and slopes with respect to the horizontal to accommodate forming tapered tubes as previously described.

A pair of stop tabs are secured to the rear (trailing) end of the replaceable die box by bolts 152 to prevent the die box from moving rearwardly as the U-shaped metal sheet enters the first of the three edge-forming fin rolls 74 (FIG. 2). Suitable stop means (not shown) are also provided for preventing the replaceable die box liner from sliding rearwardly as the metal sheet enters the edge-forming fin rolls.

The longitudinally extending and horizontal forming blades 60 and 61 on opposite sides of the die box are secured to the upper ends of respective slides 162 disposed to slide in and out on a main frame 164. The slides 162 and forming blades 60 and 61 are moved in and out by a plurality of horizontal pistons 164, each of which is mounted to reciprocate in a respective cylinder 166. For simplicity, only one cylinder and piston is shown in FIG. 17. However, two or more cylinders can be used to drive each of the forming blades in and out to bend the upper edge of the U-shaped sheet metal inwardly, as shown and described in U.S. Pat. No. 3,253,452 to Scott.

Two or more horizontal and laterally extending stabilizer shafts 170 are mounted under each of the forming blades 60 and 61, and slides 162 slide along the stabilizer shafts as the cylinders 166 are actuated to move the pistons 164 in and out.

Two or more longitudinally spaced and adjustable sheet stops 180 are mounted on the top surface of each forming blade 60 and 61 to center the metal sheet 20 in proper position under the punch 64 at the U-ing machine. Each adjustable sheet stop includes a horizontal and laterally extending shaft 182, which extends through a horizontal bore 184 in a block 186 that carries a downwardly extending dowel pin 188 that makes a snug fit in a socket 190 in a respective forming blade 60 or 61. A compression spring 192 is disposed around the shaft 182 to bear against the inner face 194 of the block 186 and to bear against the outer face 196 of a noseplate 198 secured by a set screw 200 to the inner end of the shaft 182. The inner and upper surface 201 of the noseplate tapers inwardly and downwardly, and the inner edge of the noseplate is a vertical surface 202 so that if a sheet of metal is placed on the forming blades slightly out of position, it will slide down the inclined surface 201 until the outer edge of the sheet rests on a blade 60 or 61, and against a respective vertical edge 202 of a noseplate. Each noseplate carries a downwardly extending boss 204, which makes a snug sliding fit in a laterally extending slot 206 in the upper surface of the forming blade so that the stop is not free to rotate about the vertical axis of the dowel pin 188.

An adjusting nut 208 on the outer end of shaft 182, which is threaded, can be turned to position the noseplate in the desired location. The compression spring 192 urges the noseplate and shaft 182 inwardly, and the position of the inner edge of the noseplate is determined by the location of the adjusting nut on the threaded shaft.

The upper surfaces of the forming blades include a plurality of sockets and slots to permit any required number of the adjustable sheet stops to be located where needed to fit against the outer edges of the metal sheets to be deformed at the U-ing machine.

We claim:

1. Apparatus for forming a tapered tube from an elongated metal sheet having a pair of elongated opposite side edges, the apparatus comprising:

(a) an elongated track;

(b) an elongated wagon open at its top and mounted to roll on the track, the wagon having an upwardly facing bottom curved concave upwardly about a longitudinally extending axis to form a trough in the bottom of the wagon;

(c) means for moving the wagon along the track;

(d) means for supporting the metal sheet over the trough;

(e) means for deforming the metal sheet to fit in the trough and leave the side edges of the metal sheet projecting from the wagon;

(f) at least one deforming roller disposed over the track to engage the side edges of the sheet projecting from the wagon and deform them toward each other to form a tube with an elongated seam where the side edges are adjacent each other;

(g) electrical welding means disposed over the track to engage the deformed side edges of the strip and heat them to welding temperature; and (h) forging rollers adjacent the welding means to drive the heated sides of the strip together and form a tapered tube with a welded seam extending for substantially the length of the tube.

2. Apparatus according to claim 1 in which the trough in the bottom of the wagon includes substantially parallel sides.

3. Apparatus according to claim 2 which includes means for squeezing the tube with the welded seam from an oval-shaped cross section into one which is substantially circular.

4. Apparatus according to claims 1 or 2 in which the longitudinal axis of the trough in the bottom of the axis is inclined with respect to the direction of the wagon travel on the track.

5. Apparatus according to claim 4 in which the elongated metal sheet is a trapezoid having two nonparallel side edges and two parallel end edges, and the slope of the bottom of the trough is equal to about one-half of the slope of the two side edges with respect to each other.

6. Apparatus according to claim 1 which includes a removable die box disposed in the bottom of the wagon and having an upwardly facing die cavity curved concave upwardly about a longitudinally extending axis to form the elongated trough in the bottom of the wagon.

7. Apparatus according to claim 6 in which the die box rests on adjustable spacers disposed on the bottom of the wagon.

8. Apparatus according to claims 6 or 7 in which the die cavity bottom is inclined with respect to the direction of wagon travel on the track.

9. Apparatus according to claim 1 in which the roller which engages the side edges of the sheet projecting from the wagon is a fin roller.

10. Apparatus according to claim 9 which includes a plurality of fin rollers disposed in series along the track, each fin roller being set to engage and deform the side edges toward each other.

11. A method for forming a tube from a flat metal sheet having a pair of flat opposite side edges, the method comprising the steps of:

(a) forming the flat sheet in a longitudinally extending U-shaped cavity into an elongated U-shaped trough with the pair of opposite flat side edges substantially parallel to each other and each flat edge lying in a respective plane spaced from the other by a distance about equal to that across the U-shaped cavity;

(b) thereafter deforming the flat pair of opposite side edges of the metal sheet toward each other to form an elongated tube having an oval-shaped cross section and an elongated seam where side edges of the sheet are adjacent each other; and (c) thereafter welding the adjacent edges of the sheet together while the cross section of the tube is oval-shaped.

12. A method according to claim 11 which includes the further steps of:

(a) disposing the oval-shaped tube between a pair of spaced-apart, opposed, and elongated, substantially semicircular die cavities; and (b) moving the two die cavities toward each other to cold-work and deform the tube from an oval-shaped cross section to a substantially circular cross section.

13. A method according to claim 12 in which the die cavities are oval-shaped in cross section, and which includes disposing the tube in the cavities with the long axis of the oval-shaped cross section of the tube being substantially perpendicular to that of the oval-shaped cross section of the cavities, and moving the cavities together until the tube has substantially the shape of the die cavities.

14. A method according to claim 13 in which the tube, when released from the cavities, returns to a substantially circular cross section.

15. A method according to claim 11 or 12 in which the metal sheet is in the form of a trapezoid having the pair of opposite side edges, and a pair of end edges, the end edges being of different lengths.

16. A method according to claim 15 in which the longer of the two end edges is determined from the following formula:

$$L=(\text{i OD}-\text{MT}).\pi+MT+.125'',$$

where L is the length (in inches) of the longer of the two end edges of the trapezoidal sheet, OD is the final outside diameter (in inches) of the larger end of the pipe section, MT is the actual thickness of the metal sheet (in inches), $\pi=3.14$, and 0.125 is a constant (in inches).

17. A method according to claim 16 in which the shorter end edge of the trapezoidal sheet is of a length which causes the tapered pole to taper at the rate of about $1\frac{3}{8}''$ per 10 feet of length.

18. A method according to claim 17 in which the shorter end of the trapezoidal sheet is about 4-7/16" less than the longer end of the sheet.

* * * * *

UNITED STATES PATENT AND TRADEMARK OFFICE

CERTIFICATE OF CORRECTION

PATENT NO. : 4,971,239

DATED : November 20, 1990

INVENTOR(S) : TRUETT TYLER ET AL

It is certified that error appears in the above-identified patent and that said Letters Patent is hereby corrected as shown below:

Col. 7, line 56, change "47/16"" to -- 4-7/16"

Col. 12, line 27 (claim 16, line 4), change the formula from "L=(i OD-MT).π+MT+.125" to -- L=(OD-MT).π+MT+.125 --

Signed and Sealed this

Twenty-first Day of July, 1992

*Attest:*

DOUGLAS B. COMER

*Attesting Officer*

*Acting Commissioner of Patents and Trademarks*